US006604382B2

(12) United States Patent
Shuto

(10) Patent No.: US 6,604,382 B2
(45) Date of Patent: Aug. 12, 2003

(54) NEW-CUT DIAMOND SHAPE

(76) Inventor: Naotake Shuto, 7-27, Kohyodai 4-chome, Izumi-ku, Sendai-shi 981-3102 (JP)

( * ) Notice: Subject to any disclaimer, the term of this patent is extended or adjusted under 35 U.S.C. 154(b) by 0 days.

(21) Appl. No.: 10/097,426

(22) Filed: Mar. 15, 2002

(65) Prior Publication Data

US 2002/0088450 A1 Jul. 11, 2002

Related U.S. Application Data

(62) Division of application No. 09/706,715, filed on Nov. 7, 2000, now Pat. No. 6,397,832.

(51) Int. Cl.[7] ..... A44C 17/00
(52) U.S. Cl. ..... 63/32; D11/89; D11/90
(58) Field of Search ..... 63/32; D11/89, D11/90

(56) References Cited

U.S. PATENT DOCUMENTS

| | | | | | |
|---|---|---|---|---|---|
| 732,119 | A | | 6/1903 | Schenck | |
| 839,356 | A | | 12/1906 | Wood | |
| D143,471 | S | * | 1/1946 | Fine | D11/90 |
| 3,534,510 | A | | 10/1970 | Leibowitz | |
| 3,585,764 | A | | 6/1971 | Huisman | |
| 3,763,665 | A | * | 10/1973 | Polakiewicz | 63/32 |
| 4,083,352 | A | | 4/1978 | Andrychuk | |
| 4,738,240 | A | | 4/1988 | Aich | |
| 5,190,024 | A | | 3/1993 | Senanyake | |
| D337,544 | S | * | 7/1993 | Cohen | 63/32 |
| 5,462,474 | A | | 10/1995 | Hansen | |
| D382,506 | S | * | 8/1997 | Cohen | D11/90 |
| D400,818 | S | * | 11/1998 | Rams | D11/90 |
| D410,590 | S | * | 6/1999 | Cohen | D11/90 |
| D412,136 | S | * | 7/1999 | Namdar et al. | D11/90 |
| D416,511 | S | * | 11/1999 | Rams | D11/90 |
| D437,671 | S | * | 2/2001 | Fajerstein | D1/106 |
| D439,864 | S | * | 4/2001 | Cohen | D11/90 |
| 6,305,193 | B1 | * | 10/2001 | Cheng | 63/32 |
| D451,427 | S | * | 12/2001 | Tolkowsky | D11/90 |
| D452,457 | S | * | 12/2001 | Tolkowsky | D11/90 |
| D453,120 | S | * | 1/2002 | Cheng | D11/90 |
| 6,397,832 | B1 | * | 6/2002 | Shuto | 125/30.01 |
| D459,677 | S | * | 7/2002 | Rydlewicz | D11/90 |
| D460,711 | S | * | 7/2002 | Cohen | D11/90 |
| D460,712 | S | * | 7/2002 | Cohen | D11/90 |
| D462,290 | S | * | 9/2002 | Namdar | D11/90 |

FOREIGN PATENT DOCUMENTS

| | | |
|---|---|---|
| JP | 09-011105 | 1/1997 |

* cited by examiner

*Primary Examiner*—Andrea Chop
(74) *Attorney, Agent, or Firm*—Rader, Fishman & Grauer PLLC

(57) ABSTRACT

Disclosed are a new diamond cutting method and a diamond shape or proportion giving an increased brightness and different brilliant colors to the cut jewel. A piece of diamond having a crown or bezel and a pavilion converging up and down from its girdle is prepared; the table of the crown is cut into a regular polygon having straight sides of an integer multiple of three; star facets, upper-main facets and paired upper-girdle facets are formed on the oblique annular surface between the polygonal table and the girdle; and lower-girdle facets and lower-main facets are cut on the pavilion. The height of the diamond piece is approximately 64% of the diameter of the girdle; the height of the crown is approximately 15.7%; the height of the pavilion is approximately 48.3%; and the largest width of the girdle is approximately 1.2 to 1.4%. The angle formed between the ridge of the crown and the ridge of the pavilion is approximately 77 degrees.

1 Claim, 6 Drawing Sheets

NEW-CUT DIAMOND SHAPE

This is a divisional of application No. 09/706,715, filed Nov. 7, 2000, now U.S. Pat. No. 6,397,832.

BACKGROUND OF THE INVENTION

1. Field of the Invention

The present invention relates to a diamond shape or proportion having a crown or bezel and a pavilion converging up and down from its girdle respectively and a diamond cutting method.

2. Related Arts

A fifty-eight sided diamond shape is well known, and is called round brilliant-cut diamond. One example of such brilliant-cut diamond is shown in Japanese Patent 09-011105 (A), claiming a new girdle shape of such a brilliant-cut diamond for patent.

It is absolutely necessary that a fifty-eight sided diamond shape has an octagonal table formed on its crown top. The regular octagonal shape can be determined by drawing a first reference line passing through the center of a circle to halve the circle; drawing a second reference line perpendicular to the first reference line to quadrisect the circle; drawing two intervenient lines at the angle of 45 degrees relative to each of the crossing first and second reference lines; and drawing straight lines to connect adjacent intersections of each divisional line and the circle.

The diamond shape has a thirty-three sided crown cut on its upper part. It is composed of star facets, upper-main facets or bezel facets and upper girdle facets.

Also, the diamond shape has a twenty-five sided pavilion cut on its lower part. It is composed of lower-girdle facets and lower-main facets, which are formed in the sectors delimited by the keel lines running in alignment with the divisional lines of the octagonal table. The pavilion has a culet formed on its bottom center.

The height of the brilliant-cut diamond is approximately 60.4% of the diameter of the girdle; the diameter of the table-tangential circle is approximately 55%; the height of the crown is approximately 15.4%; and the height of the pavilion is approximately 43%. This ratio is the standard proportion of A. G. S. The oblique angle of the crown is 34 degrees whereas that of the pavilion is 41 degrees.

According to the standard of G. I. A. or S. D. N. the height of the brilliant-cut diamond is approximately 59.2 to 60.4% of the diameter of the girdle; the diameter of the table-tangential circle is approximately 53 to 57.5%; the height of the crown is approximately 14.6 to 19%; and the height of the pavilion is approximately 40 to 43.1%. The oblique angle of the crown is 34.½ to 40.06 degrees whereas that of the pavilion is 38.40 to 40.¾ degrees.

Every forty-eight sided diamond which meets such standards shines blue although its brightness may be different more or less.

As is described above, a fifty-eight sided diamond piece can be formed by dividing the table-tangential circle by an integer multiple of two to determine the angle of the regular polygon and by determining other dimensions accordingly, and the resultant diamond piece shines in a relatively narrow range of color from yellow to blue.

The highest quality of fifty-eight sided diamond piece shines purple. Other high quality of diamond pieces causes a variety of prism-like effects by different ways of cutting. This suggests that new cutting other than the brilliant-cut can increase the value of jewel significantly.

SUMMARY OF THE INVENTION

One object of the present invention is to provide a diamond cutting method that can provide diamond pieces capable of multi-color shining at an increased brightness.

Another object of the present invention is to provide a diamond shape or proportion capable of multi-color shining at an increased brightness.

To attain these objects a diamond cutting method according to the present invention comprises the steps of:

preparing a piece of diamond having a crown or bezel and a pavilion converging up and down from its girdle respectively;

cutting the table of the crown into a regular polygon, which is formed by: drawing reference lines diverging radially from the center of the table, leaving between adjacent reference lines an angular distance equal to the angle determined by dividing 360 degrees by an integer multiple of three; drawing a first table-tangential circle whose diameter is equal to approximately 50 to 53% of the diameter of the girdle; and drawing straight lines between adjacent intersections of the first table-tangential circle and adjacent reference lines;

forming star facets each defined by straight lines drawn from adjacent angles of the regular polygon to a selected intersection of an intervenient bisector drawn between adjacent reference lines and a second circle drawn between the first table-tangential circle and the outermost girdle-tangential circle; and forming upper-main facets each defined by straight lines drawn from each intersection of each bisector and the second circle to each intersection of each reference line and the outermost girdle-tangential circle, and at the same time, forming paired upper-girdle facets each defined between each upper-main facet and the outermost girdle-tangential circle.

The height of the diamond piece may be approximately 64% of the diameter of the girdle; the height of the crown may be approximately 15.7%; the height of the pavilion may be approximately 48.3%; and the largest width of the girdle may be approximately 1.2 to 1.4%.

The angle formed between the ridge of the crown and the ridge of the pavilion may be approximately 77 degrees.

The shape or proportion of a diamond piece having a crown or bezel and a pavilion converging up and down from its girdle respectively, is so defined according to the present invention that:

the whole height of the diamond piece is approximately 64% of the diameter of the girdle;

the height of the crown is approximately 15.7%;

the height of the pavilion is approximately 48.3%;

the largest width of the girdle is approximately 1.2 to 1.4%;

the diameter of the tangential circle of the polygonal table is 50 to 53%, the regular polygonal shape having sides equal to the integer multiple of three;

the crown has star facets, upper-main facets and upper-girdle facets formed thereon whereas the pavilion has lower-girdle facets and lower-main facets formed on its converging surface, each lower-main facet being partly sandwiched between adjacent lower main facets in each of the sectors, which are delimited by the keel lines extending from the intersections of the bisectors each extending between adjacent reference lines passing through the apexes of the polygonal table and the girdle-tangential circle to the bottom center of the pavilion, at which bottom center the culet is formed, the lower-main facets converging to the culet.

The polygonal table, the star facets, the upper-main facets and the upper-girdle facets together may form a 37- or 49-sided crown whereas the lower-girdle facets, the lower-main facets and the culet together may form a 28- or 37-sided pavilion, thus providing a 65- or 86-sided diamond piece.

The angle formed between the ridge of the crown and the ridge of the pavilion may be approximately 77 degrees.

Other objects and advantages of the present invention will be understood from the following description of some preferred embodiments according to the present invention, which are shown in accompanying drawings.

DETAILED DESCRIPTION OF PREFERRED EMBODIMENT

Figure 1:
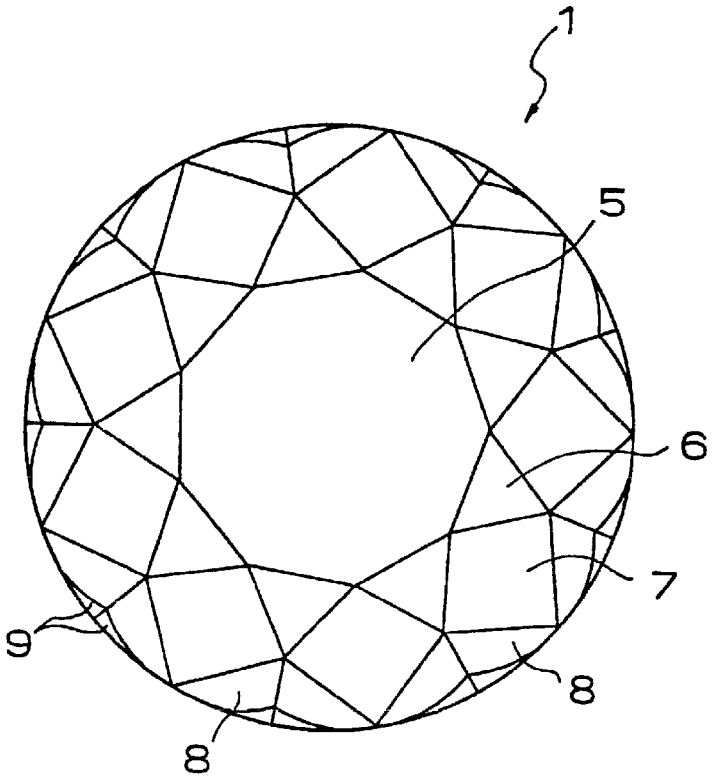
FIG. 1 is a plane view of a diamond piece according to a first embodiment of the present invention.
Figure 2:
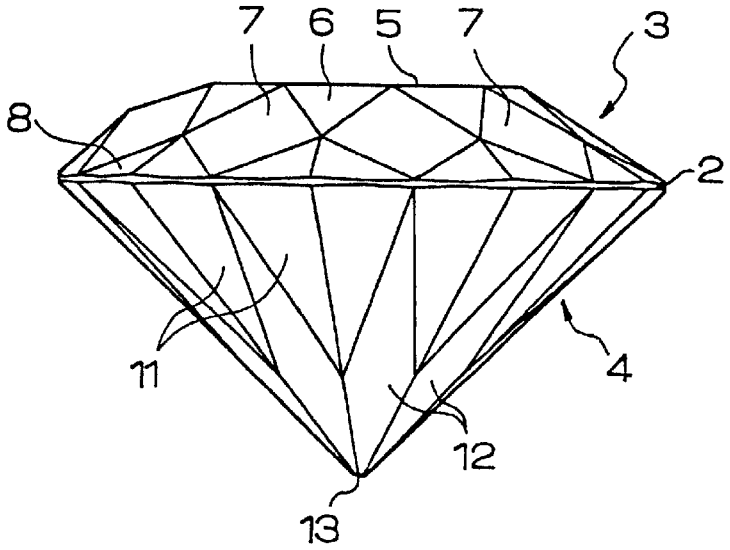
FIG. 2 is a side view of the diamond piece.

Referring to FIGS. 1 to 7, a piece of diamond 1 cut according to the first embodiment has a crown or bezel 3 and a pavilion 4 converging up and down from its girdle 2 respectively, and it looks like a round brilliant-cut diamond.

The table 5 of the crown 3 is cut into a regular shape having nine straight sides or nonagon, and star facets 6 are formed to be contiguous to each straight side of the nonagon. A bezel facet or upper-main facet 7 is formed between adjacent star facets 6, and each pair of upper-girdle facets 8 are formed between adjacent upper-main facets 7. Thus, a thirty-seven sided crown 3 results. An extra facet 9 may be formed between each upper-girdle facet 8 and the girdle 2 (see FIG. 1). Such extra facets 9, however, cannot be counted as flat sides of a cut jewel because they can be formed automatically as recesses in forming the girdle 2 in the diamond piece.

Figure 3:
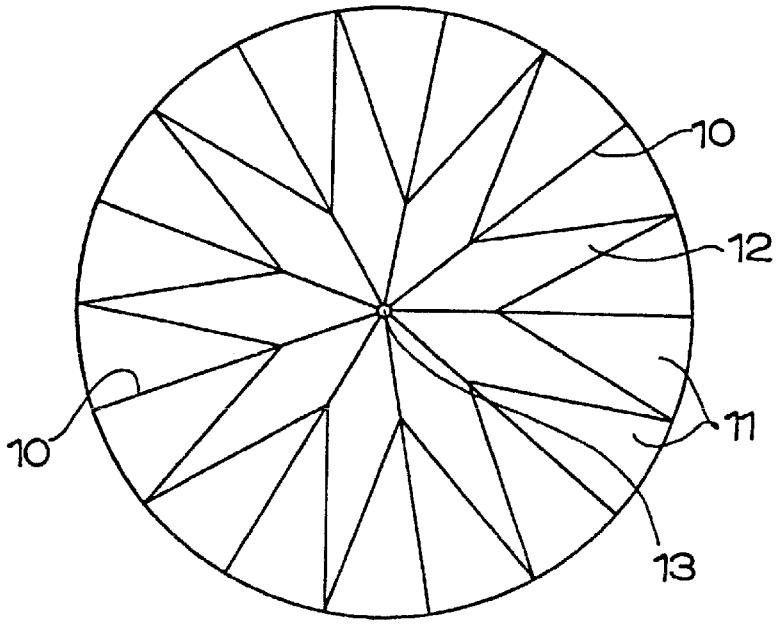
FIG. 3 is a bottom view of the diamond piece.

Referring to FIG. 3, the pavilion 4 has lower-girdle facets 11 and lower-main facets (or pavilion facets) 12 formed on its converging surface. Specifically, each lower-main facet 12 is partly sandwiched between adjacent lower girdle facets 11 in each of the sectors. These sectors are delimited by the keel lines 10 extending from the intersections of the bisectors "c" drawn between adjacent reference lines "a" passing through the apexes of the polygonal table 5 and the girdle-tangential circle to the bottom center of the pavilion 4, at which bottom center the culet 13 is formed. The lower-main facets 12 converge to the culet 13. Thus, a twenty-eight sided pavilion 4 results.

The diamond shape 1 thus cut according to the present invention provides a sixty-five sided body, which is composed of a thirty-seven sided crown 3 and a twenty-eight sided pavilion 4, the crown 3 having a nonagon table 5. As seen from FIG. 2, the girdle 2 has hardly noticeable hills and valleys formed at nine points, at which the upper-girdle facets 8 and the lower-girdle facets 11 confront. One feature of the diamond shape is that every longitudinal section is not symmetrical with respect to its center axis because of the nonagon table 5.

Figure 4:
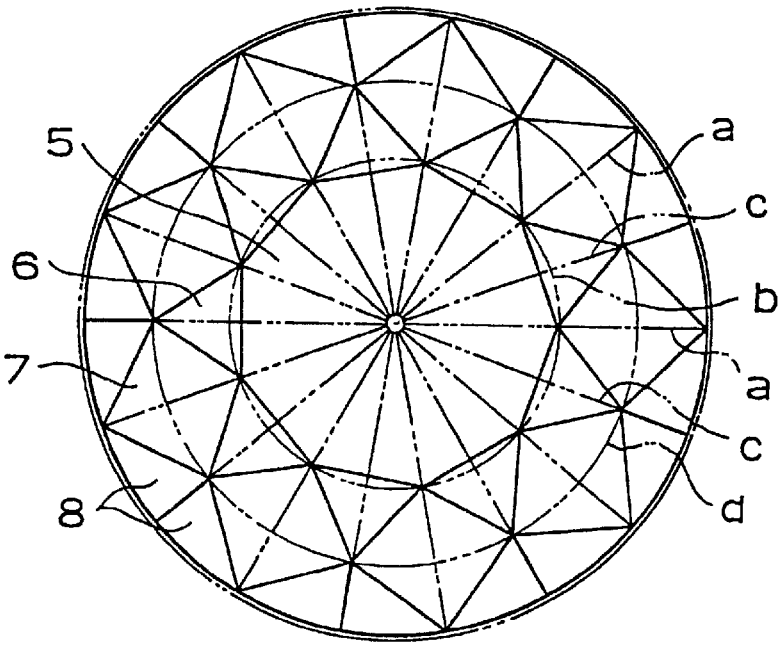
FIG. 4 illustrates how cutting lines are drawn to form the crown of the diamond piece.

Referring to FIG. 4, the manner in which the table 5 is cut to be of a regular nonagon shape is described. First, reference lines "a" are drawn so that they may diverge radially from the center of the table 5, leaving between adjacent reference lines an angular distance of 40 degrees, which is equal to the angle determined by dividing 360 degrees by nine. Then, a first table-tangential circle "b" whose diameter is equal to approximately 50 to 53% of the diameter of the girdle 2 is drawn. Straight lines are drawn between adjacent intersections of the first table-tangential circle "b" and adjacent reference lines "a". This is different from the round brilliant-cut in which a table-tangential circle is divided by an integer multiple of two rather than dividing 360 degrees by an integer multiple of three (3, 6, 9, 12, 15 and so forth).

Star facets 6 are formed, each star facet being defined by straight lines drawn from adjacent angles or apexes of the regular polygon to a selected intersection of an intervenient bisector "c" drawn between adjacent reference lines "a" and a second circle "d" drawn between the first table-tangential circle "b" and the outermost girdle-tangential circle. Each star facet 6 is a triangle having one side in common with a selected straight side of the nonagon table 5.

Upper-main facets 7 are formed, each defined by straight lines drawn from each intersection of each bisector "c" and the second circle "d" to each intersection of each reference line "a" and the outermost girdle-tangential circle. Paired upper-girdle facets 8 are formed, each defined between each upper-main facet 7 and the outermost girdle-tangential circle by drawing a normal line from the intersection of each bisector "c" and the second circle "d" to the outermost girdle-tangential circle at right angle. The circumference indicated by the girdle-tangential circle (phantom line) is cut and removed when the girdle 2 is formed.

Figure 5:
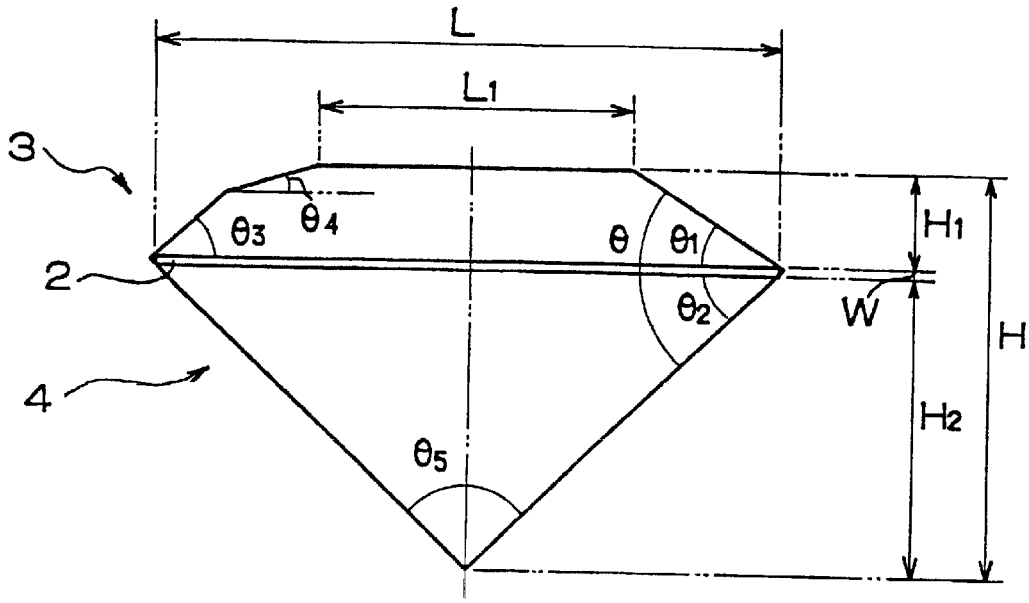
FIG. 5 is a side view of the diamond piece, illustrating how it is designed according to the present invention.
Figure 6:
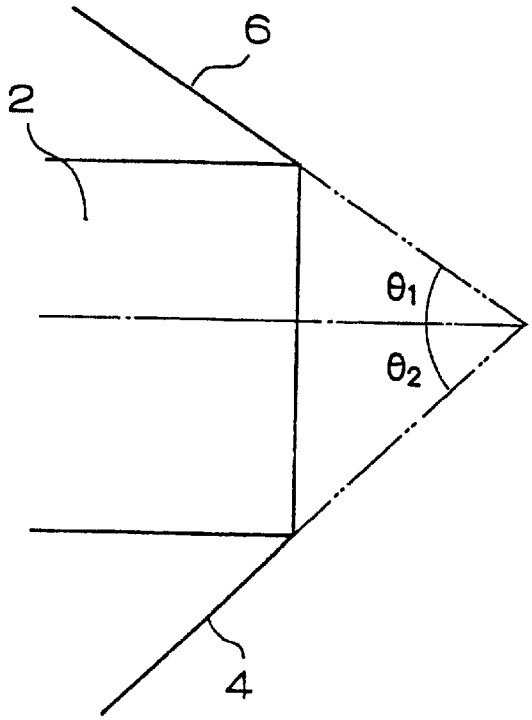
FIG. 6 is a side view of a fragment of the diamond piece, illustrating the girdle at an enlarged scale.
Figure 7:
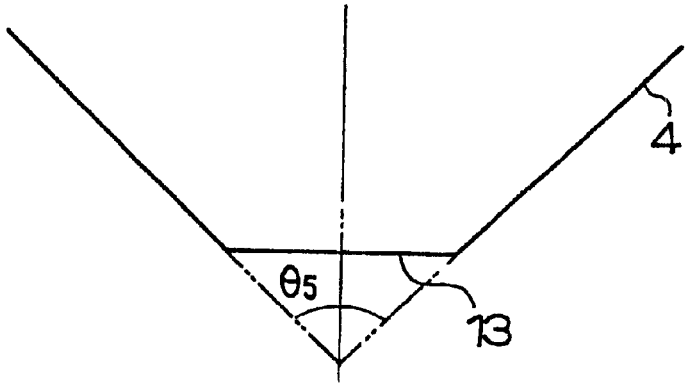
FIG. 7 is a side view of the bottom of the diamond piece, illustrating how the culet is formed at an enlarged scale.

Referring to FIGS. 5 to 7, the sizes of different portions of the diamond shape are given as follows: the height "H" of the diamond piece is approximately 64% of the diameter of the girdle 2; the height "$H_1$" of the crown 3 is approximately 15.7%; the height "$H_2$" of the pavilion 4 is approximately 48.3%; the largest width "W" of the girdle 2 is approximately 1.4%; and the diameter "$L_1$" of the table 5 is approximately 51%.

The angle $\theta$ formed between the ridge of the crown 3 and the ridge of the pavilion 4 is approximately 77 degrees. The angle $\theta_1$ formed between the ridge of the crown 3 and the imaginary girdle-containing plane (that is, the oblique angle of the upper-main facet) is approximately 33 degrees whereas the angle $\theta_2$ formed between the ridge of the pavilion 4 and the imaginary girdle-containing plane is approximately 44 degrees.

The angle $\theta_3$ formed between the ridge of the upper-girdle facet 8 and the imaginary girdle-containing plane is approximately 43 degrees, and the oblique angle $\theta_4$ of the star facet 6 is approximately 18 degrees.

The whole height of the cut jewel, the height and oblique angle of the crown 3 and the height and oblique angle of the pavilion 4 are determined as such, and as a consequence the converging angle $\theta_5$ of the pavilion bottom is approximately 92 degrees, and the diameter of the culet 13 is approximately 1.6% of the diameter "L" of the girdle 2. The lower-girdle facets 11 and the lower-main facets 12 can be designed and cut on the pavilion 4 according to the conventional way.

As may be understood from the above, a diamond cut according to the first embodiment has a nonagon table 5 on its crown 3 and facets delimited by nine keel lines 10.

Figure 8:
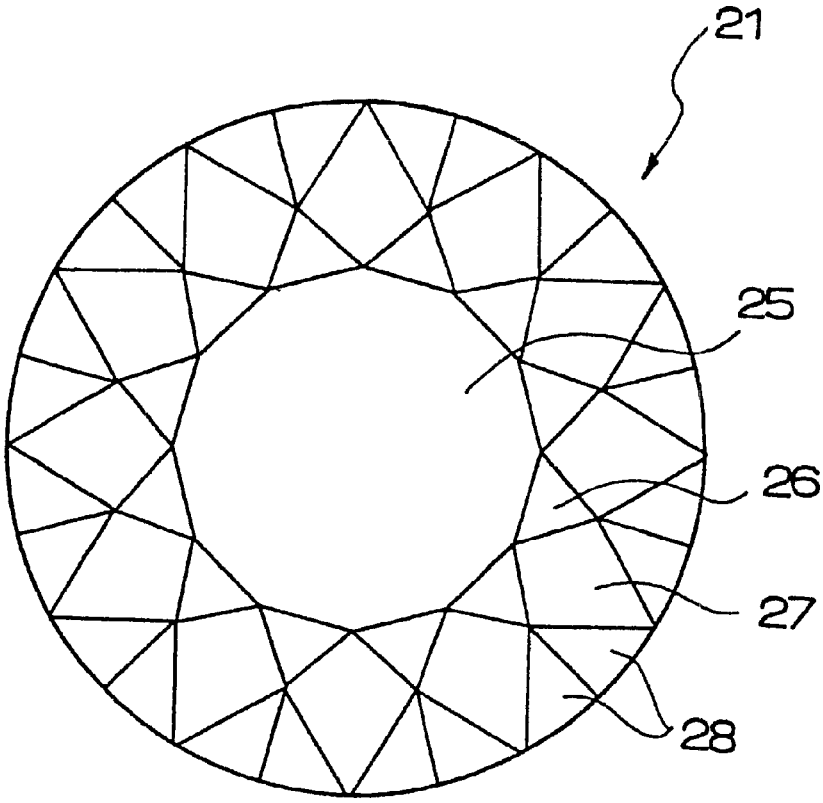
FIG. 8 is a plane view of a diamond piece according to a second embodiment of the present invention.
Figure 9:
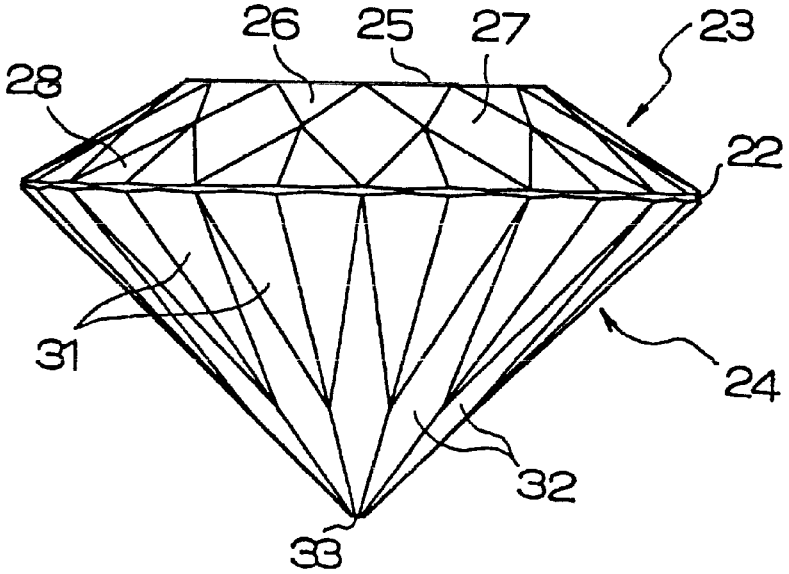
FIG. 9 is a side view of the diamond piece.
Figure 10:
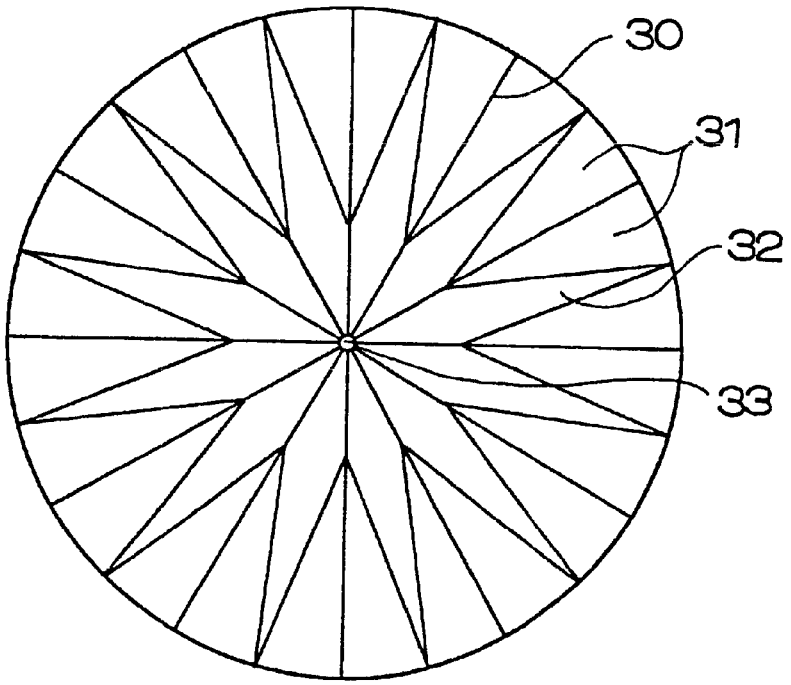
FIG. 10 is a bottom view of the diamond piece.

Referring to FIGS. 8 to 10, a diamond shape 21 according to the second embodiment has a crown 23 and a pavilion 24 converging up and down from its girdle 22 respectively.

The table 25 of the crown 23 is cut into a regular shape having twelve straight sides or dodecagon, and star facets 26 are formed to be contiguous to each straight side of the dodecagon. Each bezel facet or upper-main facet 27 is formed between adjacent star facets 26, and each pair of upper-girdle facets 28 are formed between adjacent upper-main facets 27. Thus, a forty-nine sided crown 23 results.

Referring to FIG. 10, the pavilion 24 has lower-girdle facets 31 and lower-main facets (or pavilion facets) 32 formed on its converging surface. Specifically, each lower-main facet 32 is partly sandwiched between adjacent lower girdle facets 31 in each of the sectors, which are delimited by keel lines 30. On the pavilion 24 these keel lines 30 run in alignment with the bisectors "c" between adjacent reference lines "a" passing through the apexes of the dodecagon table 25 (see FIG. 11) to converge to the bottom center of the pavilion 24, at which bottom center the culet 33 is formed. Thus, a thirty-seven sided pavilion 24 results.

The diamond shape 21 thus cut according to the second embodiment of the present invention provides an eighty-six sided body, which is composed of a forty-nine sided crown 23 and a thirty-seven sided pavilion 24. The crown 23 has a dodecagon table 25. As seen from FIG. 9, the girdle 22 has hardly noticeable hills and valleys formed on its circumference.

Figure 11:
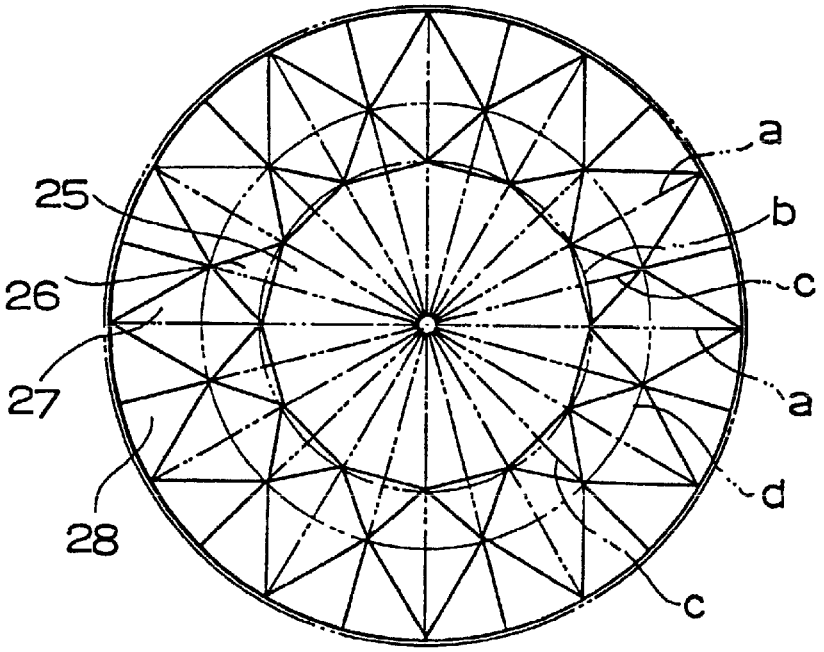
FIG. 11 illustrates how cutting lines are drawn to form the crown of the diamond piece.

Referring to FIG. 11, the manner in which the table 25 is cut to be of a regular dodecagon shape is described. First, reference lines "a" are drawn so that they may diverge radially from the center of the table 25, leaving between adjacent reference lines an angular distance of 30 degrees, which is equal to the angle determined by dividing 360 degrees by twelve. Then, a first table-tangential circle "b" whose diameter is equal to approximately 50 to 53% of the diameter of the girdle 22 is drawn. Straight lines are drawn between adjacent intersections of the first table-tangential circle "b" and adjacent reference lines "a". Thus, a regular dodecagon is formed.

Star facets 26 are formed, each star facet being defined by straight lines drawn from adjacent angles or apexes of the regular dodecagon to a selected intersection of an intervenient bisector "c" drawn between adjacent reference lines "a" and a second circle "d" drawn between the first table-tangential circle "b" and the outermost girdle-tangential circle. Each star facet 26 is a triangle having one side in common with a selected straight side of the dodecagon table 25.

Upper-main facets 27 are formed, each defined by straight lines drawn from each intersection of each bisector "c" and the second circle "d" both to each intersection of each reference line "a" and the outermost girdle-tangential circle, and to each intersection of each reference line "a" and the table-tangential circle (or each apex of the dodecagon). Paired upper-girdle facets 28 are formed, each defined between each upper-main facet 27 and the outermost girdle-tangential circle by drawing a normal line from the intersection of each bisector "c" and the second circle "d" to the outermost girdle-tangential circle at right angle. The circumference indicated by the girdle-tangential circle (phantom line) is cut and removed when the girdle 22 is formed.

Figure 12:
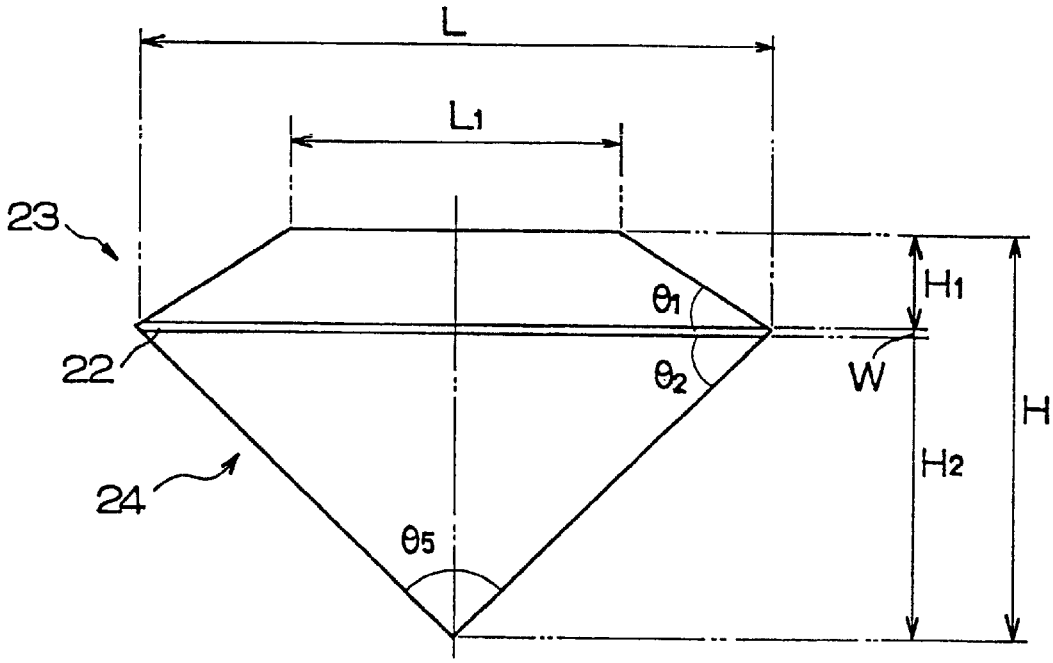
FIG. 12 is a side view of the diamond piece, illustrating how it is designed.

Referring to FIG. 12, the sizes of different portions of the diamond shape are given as follows: the height "H" of the diamond piece is approximately 64% of the diameter "L" of the girdle 22; the height "$H_1$" of the crown 23 is approximately 15.7%; the height "$H_2$" of the pavilion 24 is approximately 48.3%; the largest width "W" of the girdle 22 is approximately 1.2%; and the diameter "$L_1$" of the table 25 is approximately 52%.

The angle $\theta$ formed between the ridge of the crown 23 and the ridge of the pavilion 24 is approximately 77 degrees. The angle $\theta_1$ formed between the ridge of the crown 23 and the imaginary girdle-containing plane is approximately 33 degrees whereas the angle $\theta_2$ formed between the ridge of the pavilion 24 and the imaginary girdle-containing plane is approximately 44 degrees.

The whole height of the cut jewel, the height and oblique angle of the crown 23 and the height and oblique angle of the pavilion 24 are determined as such, and as a consequence, the converging angle $\theta_5$ of the pavilion bottom is approximately 92 degrees, and the diameter of the culet 13 is approximately 1.6% of the diameter "L" of the girdle 22. The lower-girdle facets 31 and the lower-main facets 32 can be designed and cut on the pavilion 24 according to the conventional way.

All sizes and angles may vary within the allowable range from 0.1 to 2, and errors below 0.1 may be permitted.

A diamond piece 1 cut according to the first embodiment shines yellow in the table 5, green around the table 5, that is, in the star facets 6, blue in the upper-main facets 7 and purple to violet in the upper-girdle facets 8. A diamond piece 21 cut according to the second embodiment shines purple to violet as a whole.

The brightness of the diamond piece cut according to the first embodiment increases approximately 12% in comparison with the round brilliant-cut diamond whereas that of the diamond piece cut according to the second embodiment increases approximately 250% in comparison with the round brilliant-cut diamond. The diamond cut according to the present invention shines much more brilliant than the conventional fifty-eight sided round brilliant-cut diamond.

The reason why the brightness of the diamond piece cut according to the present invention is unknown, but it seems that: partly because of the facets in the pavilion being formed to be in conformity with the nonagon or dodecagon shape of the table in the crown, and partly because of the specified sizes and angles of the crown and pavilion relative to the diameter of the girdle the prism effect is enhanced in the cut jewel.

The feature of the diamond shape according to the present invention resides in: a polygon table having straight sides of an integer multiple of three; the specified angle formed between the up-converging crown and the down-converging pavilion; and the specified ratios of the whole height, crown height and pavilion height relative to the girdle diameter. All of these factors provide a diamond pieces capable of multicolor shining at an increased brightness.

What is claimed is:

1. A diamond piece having a crown or bezel and a pavilion converging up and down from its girdle respectively, the shape or proportion of said diamond piece being defined by:

the whole height of the diamond piece being equal to or substantially equal to 64% of the diameter of the girdle;

the height of the crown being equal to or substantially equal to 15.7% of the diameter of the girdle;

the height of the pavilion being equal to or substantially equal to 48.3% of the diameter of the girdle;

the largest width of the girdle being equal to or substantially equal to 1.2 to 1.4% of the diameter of the girdle;

the diameter of a tangential circle of the polygonal table is 50 to 53% of the diameter of the girdle, the polygonal table having sides equal to the integer multiple of three;

the crown has star facets, upper-main facets and upper-girdle facets formed thereon, whereas the pavilion has lower-girdle facets and lower-main facets formed on its converging surface and has sectors delimited by keel lines which extend from intersections of bisectors each extending between adjacent reference lines passing through respective apexes of the polygonal table and the girdle-tangential circle to the bottom center of the pavilion, at which bottom center a culet is formed, the lower-main facets converging to the culet.

* * * * *